US012654055B2

(12) United States Patent
Nolan et al.

(10) Patent No.: US 12,654,055 B2
(45) Date of Patent: Jun. 16, 2026

(54) BARBELL

(71) Applicant: Bulletproof Fitness Equipment Inc, Acton, CA (US)

(72) Inventors: Nicole K Nolan, Santa Clarita, CA (US); Lawrence R Nolan, Santa Clarita, CA (US); Christopher I Gaddy, Brooklyn, NY (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 105 days.

(21) Appl. No.: 18/614,383

(22) Filed: Mar. 22, 2024

(65) Prior Publication Data

US 2024/0316388 A1 Sep. 26, 2024

Related U.S. Application Data

(60) Provisional application No. 63/491,668, filed on Mar. 22, 2023.

(51) Int. Cl.
*A63B 21/072* (2006.01)

(52) U.S. Cl.
CPC ..... *A63B 21/0724* (2013.01)

(58) Field of Classification Search
CPC ..... A63B 21/0724; A63B 21/4035; A63B 21/4049; A63B 23/1236; A63B 2071/026; A63B 2208/0204; A63B 2208/0257; A63B 2225/09; A63B 2225/105
See application file for complete search history.

(56) References Cited

U.S. PATENT DOCUMENTS

| | | | | |
|---|---|---|---|---|
| 3,384,370 A | | 5/1968 | Bailey et al. | |
| 4,585,229 A | * | 4/1986 | Brasher | A63B 21/0724 482/106 |
| 4,618,143 A | * | 10/1986 | Twardosz | A63B 21/0724 482/106 |
| 4,690,400 A | * | 9/1987 | Metz | A63B 21/0724 482/106 |
| 4,743,018 A | * | 5/1988 | Eckler | A63B 21/075 482/106 |
| 4,822,035 A | * | 4/1989 | Jennings | A63B 21/0724 482/106 |

(Continued)

FOREIGN PATENT DOCUMENTS

| | | |
|---|---|---|
| DE | 223926 A1 | 6/1985 |
| EP | 3583984 A1 | 12/2019 |

*Primary Examiner* — Joshua Lee
(74) *Attorney, Agent, or Firm* — AVEK IP, LLC

(57) ABSTRACT

A barbell includes a frame with a first outer bar and a second outer bar forming an opening therebetween; a first handle assembly mounted within the opening and having a first handle supported by a first outer member; and a first inner member rotationally engaged with the first outer member such that the first outer member can spin about the first inner member to alter a position of the first handle within the opening; a second handle assembly mounted within the opening and having a second handle supported by a second outer member; and a second inner member rotationally engaged with the second outer member such that the second outer member can spin about the second inner member to alter a position of the second handle within the opening; and weight bars extending from the frame to receive weights.

20 Claims, 2 Drawing Sheets

(56) References Cited

U.S. PATENT DOCUMENTS

| | | | | | |
|---|---|---|---|---|---|
| RE33,218 | E * | 5/1990 | Twardosz | A63B 21/0724 | 482/106 |
| 5,024,434 | A * | 6/1991 | Smith | A63B 21/0728 | 482/106 |
| 5,211,616 | A * | 5/1993 | Riley, Jr. | A63B 21/072 | 482/106 |
| 7,094,186 | B2 * | 8/2006 | Diakonov | A63B 21/0728 | 482/106 |
| 8,672,815 | B1 * | 3/2014 | Springer | A63B 21/0724 | 482/106 |
| 10,159,868 | B2 * | 12/2018 | Light | A63B 21/072 | |
| 10,888,731 | B2 * | 1/2021 | Olmstead | A63B 21/0724 | |
| 11,000,725 | B2 * | 5/2021 | Light | A63B 21/4049 | |
| 11,426,621 | B2 | 8/2022 | Bauerle | | |
| 11,504,572 | B2 * | 11/2022 | Kinney | A63B 21/0557 | |
| 11,648,438 | B2 | 5/2023 | Bauerle | | |
| 11,701,543 | B1 * | 7/2023 | Smith, Jr. | A63B 71/0036 | 482/104 |
| 11,865,404 | B2 * | 1/2024 | Hitman | A63B 21/068 | |
| 12,023,545 | B2 * | 7/2024 | Kinney | A63B 21/0724 | |
| 12,134,005 | B2 * | 11/2024 | Kinney | A63B 21/0724 | |
| 2004/0082448 | A1 | 4/2004 | Martin | | |
| 2008/0176723 | A1 | 7/2008 | Johnson | | |
| 2013/0035218 | A1 * | 2/2013 | Wierszewski | A63B 21/072 | 482/106 |
| 2018/0243605 | A1 * | 8/2018 | Light | A63B 21/072 | |
| 2020/0289870 | A1 | 9/2020 | Olmstead et al. | | |
| 2021/0154523 | A1 | 5/2021 | Hitman | | |
| 2021/0346749 | A1 * | 11/2021 | Küttel | A63B 1/00 | |
| 2022/0273979 | A1 | 9/2022 | Kinney et al. | | |
| 2023/0173332 | A1 * | 6/2023 | Bauerle | A63B 21/0724 | 482/115 |

* cited by examiner

BARBELL

RELATED APPLICATIONS

This application claims priority to U.S. provisional application No. 63/491,668 filed Mar. 22, 2023, which is incorporated by reference in its entirety herein.

FIELD OF INVENTION

The disclosure relates generally to exercise equipment. More specifically, the disclosure relates to a barbell that includes handles that are rotationally adjustable and adjustable in distance relative to one another.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a barbell, comprising a frame with a first outer bar and a second outer bar forming an opening therebetween; a first handle assembly mounted within the opening; and a second handle assembly mounted within the opening. The first handle assembly includes a first handle supported by a first outer member; and a first inner member rotationally engaged with the first outer member such that the first outer member can spin about the first inner member to alter a position of the first handle within the opening. The second handle assembly includes a second handle supported by a second outer member; and a second inner member rotationally engaged with the second outer member such that the second outer member can spin about the second inner member to alter a position of the second handle within the opening. The barbell further includes one or more weight bars extending from the frame and configured to receive weights. A user utilizes the first handle and the second handle to manipulate the weights.

BRIEF DESCRIPTION OF THE DRAWINGS

Embodiments of the invention are described in detail below with reference to the attached drawings.

The drawings do not limit the invention to the specific embodiments disclosed and described herein. The drawings are not necessarily to scale, emphasis instead being placed upon clearly illustrating various principles of the disclosure.

LIST OF REFERENCES

100—Barbell
101—Frame
102—Outer Bar
104—Outer Bar
106—Crossbar

108—Handle Assembly
110—Handle Assembly
112—Weight Bar
114—Weight Bar
116—Handle
118—Outer Member
120—Inner Member
122—Apertures
124—Locking Pin
126—Tubular Guide
128—Locking Pin
130—Apertures
132—Tubular Guide
134—Handle
136—Outer Member
138—Inner Member
140—Apertures
142—Locking Pin
144—Tubular Guide
145—Tubular Guide
146—Locking Pin
148—Apertures
150*a-h*—Pegs
200—Port
202—Port
204—Connector
206—Connector
208—Locking Pin
210—Locking Pin
212*a-c*—Rings
214*a-b*—Rails

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on their needs. One type of exercise equipment is a barbell, which may allow for a user to add and remove weight to customize their workout. In some instances, a user may desire to have adjustable hand placement relative to weight distribution. For example, a user may want their hands closer together or further apart. As another example, a user may want their hands positioned at a custom angle relative to a weight axis. The present invention provides for a barbell with a customizable handle system to allow for a user to adjust their hand placement as needed or desired.

Figure 1:
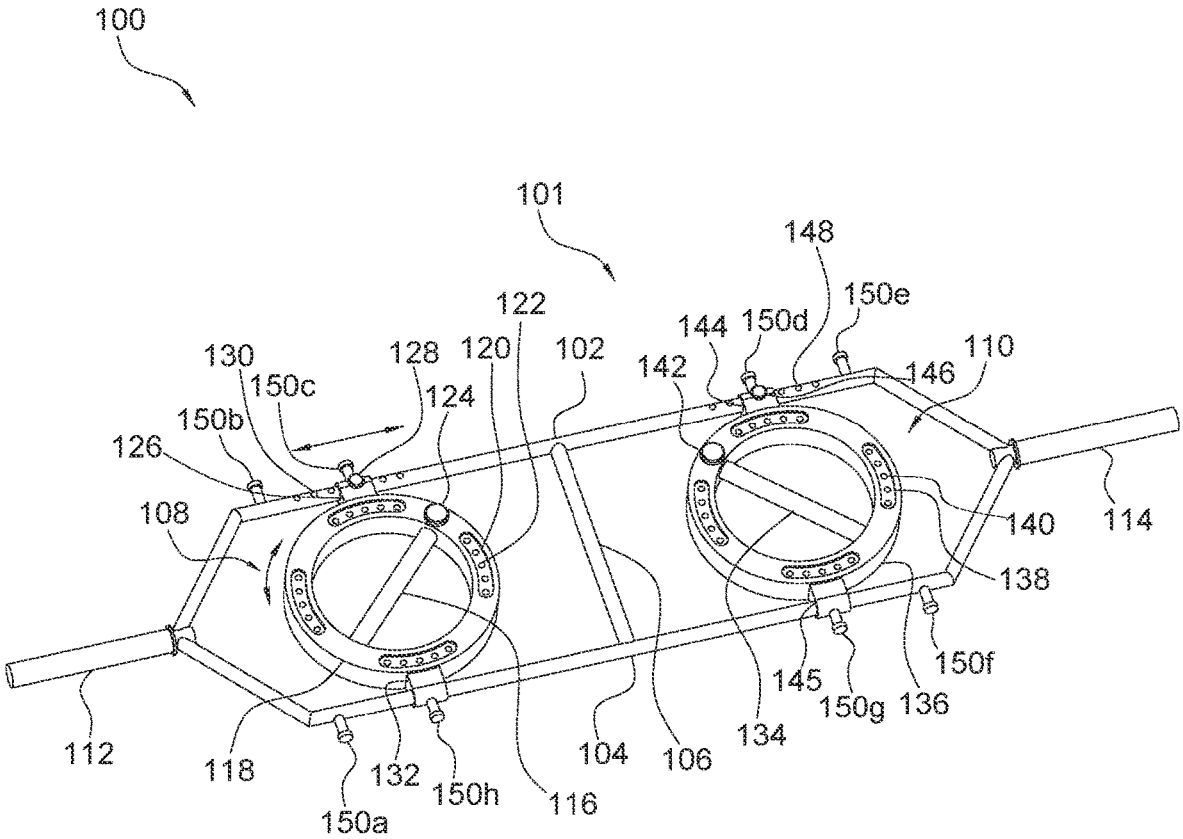
FIG. 1 is a top perspective view of a barbell in accordance with the present disclosure.

As shown best in FIG. 1, the barbell 100 includes a frame 101 having a first outer bar 102 and a second outer bar 104 forming an opening therebetween. The outer bars 102, 104 extend from end to end, wherein a first weight bar 112 and a second weight bar 114 are connected to the frame to allow for a user to add or remove weight to customize their workout. The overall size and dimensions of the frame 101 can vary as would be understood by those skilled in the art. The frame 101 may further include a crossbar 106 and supports a first handle assembly 108 and a second handle assembly 110. The handle assemblies each include a handle 116, 134 that is adjustable in at least two directions, as shown with the associated arrows.

The first handle assembly 108 includes the handle 116 mounted within an outer member 118 which is slidingly engaged with an inner member 120. In other words, the outer member 118 is essentially a hollow circle, with the inner member 120 mounted therein, such that the outer member 118 selectively spins around the inner member 120. This allows for the angle of the handle 116 to be adjusted. Although varying means of adjustability and locking can be used, in some embodiments, a plurality of apertures 122 into the inner member 120 allow for a locking pin 124 to extend therethrough, thereby locking the handle 116 into a position.

The first handle assembly 108 further includes a means of adjustability from side to side, such that the user can adjust the width of their grip (i.e. the distance between their hands). The first handle assembly 108 includes a tubular guide 126 slidingly engaged with the outer bar 102 and may include a second tubular guide 132 engaged with outer bar 104. This configuration allows for the handle assembly 108 to slide from side to side. A locking pin 128 can further lock the handle assembly 108 into a position by extending through one of a plurality of apertures 130. Accordingly, the handle assembly is adjustable in at least two directions.

The second handle assembly 110 includes the same features as the first handle assembly 108. Specifically, a handle 134 is mounted within an outer member 136, the outer member 136 positioned around an inner member 138 such that the outer member 136 can slide/spin thereabout. A locking pin 142 can extend through one of a plurality of apertures 140 to lock the handle 134 within a first position. Further, tubular guides 144, 145 are slidingly engaged with outer bars 102, 104 and another locking pin 146 extends into one of a plurality of apertures 148 to lock the handle assembly 110 at a width relative to the first handle assembly.

The barbell 100 further includes a plurality of pegs 150*a-h* extending outward, the plurality of pegs 150*a-h* allow for a user to add bands or similar devices to increase resistance while using the barbell. In embodiments, the pegs specifically extend outward and perpendicular to the outer bars 102, 104.

Figure 2:
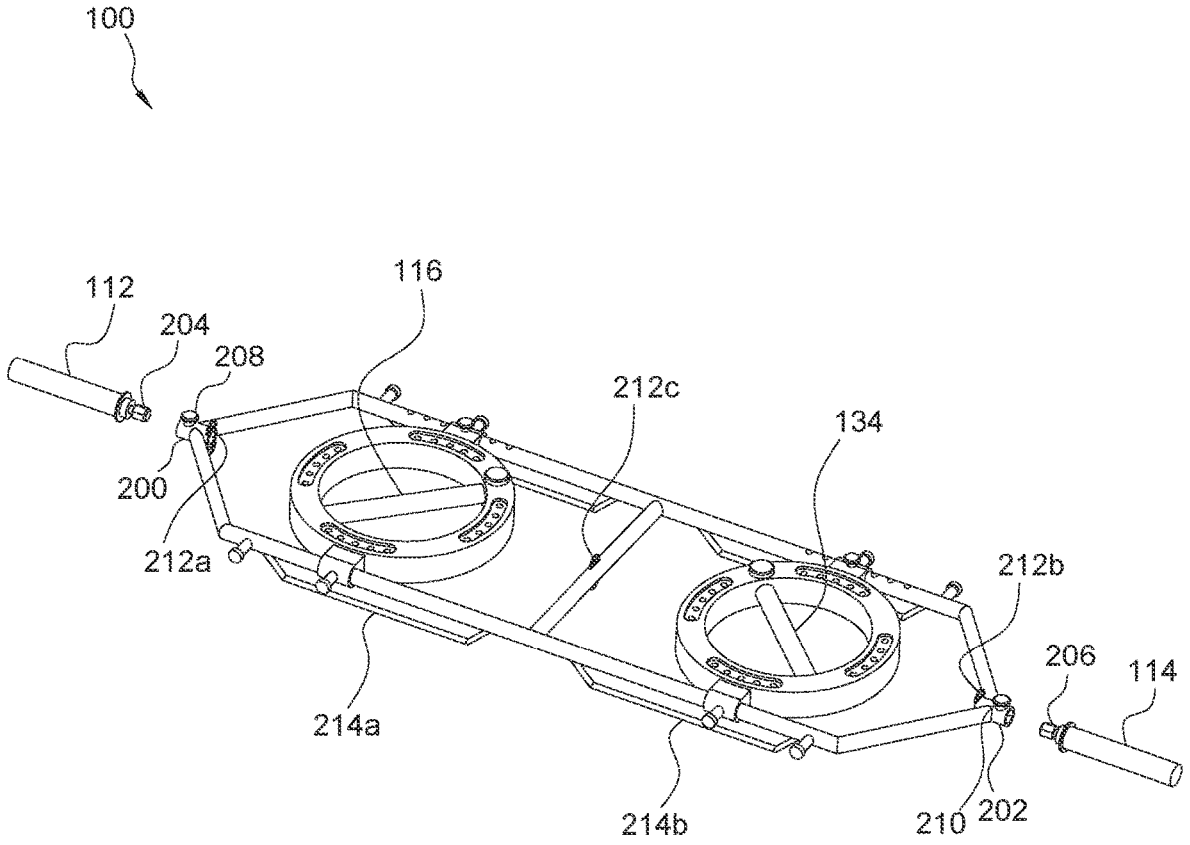
FIG. 2 is an angled perspective view of an alternative embodiment of a barbell in accordance with the present disclosure.

Turning to FIG. 2, the barbell 100 is shown having additional features, as well as the features discussed above is shown. FIG. 2 demonstrates the weight bars 112, 114 in a removable configuration. In this configuration, a first port 200 and a second port 202 are provided to receive connectors 204, 206 such that the weight bars 112, 114 are removably engaged. Additional locking pins 208, 210 are used to lock the components together. Those skilled in the art will appreciate that the ports and connectors may be reversed, i.e. the ports may be part of the weight bars, while the connectors extend from the frame. In embodiments, the connectors 204, 206 are hexagonal in cross sectional shape to create a secure lock once engaged with the ports 200, 202. The hexagonal cross section of the connectors prevents the connectors from rotating within a similar hexagonal port.

FIG. 2 further demonstrates a plurality of rings 212*a-c*, which provide additional locations to secure accessories, such as resistance bands or other devices. Further shown are rails 214*a-b* which extend from a bottom side of the frame, such that the rails rest on a surface (e.g. the ground), when the barbell 100 is not in use. These features allow for the handles 116, 134 to be elevated above the surface to allow for easy grip by the user.

During use, the user may adjust the angle of the handles, as well as their position to one another and lock the adjustments in place before performing an exercise. Alternatively, the user may disengage the locking members and allow for the handles to rotate and slide freely during the exercise.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A barbell, comprising:

a frame with a first outer bar and a second outer bar forming an opening therebetween;

a first handle assembly mounted within the opening, the first handle assembly having:

a first handle supported by a first outer member; and a first inner member rotationally engaged with the first outer member such that the first outer member can spin about the first inner member to alter a position of the first handle within the opening;

a second handle assembly mounted within the opening, the second handle assembly having:

a second handle supported by a second outer member; and a second inner member rotationally engaged with the second outer member such that the second outer member can spin about the second inner member to alter a position of the second handle within the opening; and one or more weight bars extending from the frame and configured to receive weights;

wherein the first outer member is a first circular structure and the first inner member is a second circular structure positioned within the first circular structure such that the first circular structure can spin around the second circular structure; and wherein the first handle and the second handle are configured to manipulate the weights during use.

2. The barbell of claim 1, wherein the first handle extends a diameter of the first circular structure.

3. The barbell of claim 1, wherein the first inner member further comprises a plurality of apertures configured to selectively receive a locking pin to lock the first outer member in a position relative to the first inner member.

4. The barbell of claim 1, further comprising:

a first tubular guide extending from the first outer member and configured to slidingly engage with the first outer bar; and a second tubular guide extending from the first outer member and configured to slidingly engage with the second outer bar.

5. The barbell of claim 4, wherein the first tubular guide and the second tubular guide allow for the first handle assembly to slide within the opening.

6. The barbell of claim 5, further comprising a locking pin configured to extend through the first tubular guide and into the first outer bar to lock the first handle assembly in a position.

7. The barbell of claim 1, further comprising:

a plurality of pegs extending from the barbell; and a plurality of rings extending from the barbell.

8. The barbell of claim 7, wherein the plurality of pegs comprises at least two pegs extending outward from the first outer bar and at least two pegs extending outward from the second outer bar.

9. The barbell of claim 1, wherein the one or more weight bars further comprises a first weight bar and a second weight bar.

10. The barbell of claim 9, further comprising a first port extending from the frame and a first connector extending from the first weight bar, the first connector configured to secure within the first port to secure the first weight bar to the frame.

11. The barbell of claim 10, wherein the first connector has a hexagonal cross section.

12. The barbell of claim 1, further comprising a crossbar extending between the first outer bar and the second outer bar.

13. The barbell of claim 1, further comprising a first rail extending downward from the frame, the first rail configured to support the frame a distance off of a surface such that the first handle assembly and the second handle assembly do not come into contact with the surface.

14. A barbell, comprising:

a frame with a first outer bar and a second outer bar forming an opening therebetween;

a first handle assembly mounted within the opening, the first handle assembly having:

a first handle supported within a first circular opening created by a first outer member and a first inner member, the first inner member and the first outer member are rotationally engaged such that rotation alters a position of the first handle within the first circular opening;

a second handle assembly mounted within the opening, the second handle assembly having:

a second handle supported within a second circular opening created by a second outer member and a second inner member, the second inner member and the second outer member are rotationally engaged such that rotation alters a position of the second handle within the second circular opening;

a first tubular guide extending from the first outer member and configured to slidingly engage with the first outer bar;

a second tubular guide extending from the first outer member and configured to slidingly engage with the second outer bar; and one or more weight bars extending from the frame and configured to receive weights;

wherein the first handle and the second handle are configured to manipulate the weights during use.

15. The barbell of claim 14, wherein the first tubular guide and the second tubular guide allow for the first handle assembly to slide within the opening.

16. The barbell of claim 15, further comprising a locking pin configured to extend through the first tubular guide and into the first outer bar to lock the first handle assembly in a position.

17. The barbell of claim 14, further comprising:

the one or more weight bars including a first weight bar and a second weight bar; and a first port extending from the frame and a first connector extending from the first weight bar, the first connector configured to secure within the first port to secure the first weight bar to the frame.

18. The barbell of claim 17, wherein the first connector has a hexagonal cross section.

19. A barbell, comprising:

a frame with a first outer bar and a second outer bar forming an opening therebetween;

a first handle assembly mounted within the opening, the first handle assembly having:

a first handle supported within a first circular opening created by a first outer member and a first inner member, the first inner member and the first outer member are rotationally engaged such that rotation alters a position of the first handle within the first circular opening;

a second handle assembly mounted within the opening, the second handle assembly having:

a second handle supported within a second circular opening created by a second outer member and a second inner member, the second inner member and the second outer member are rotationally engaged such that rotation alters a position of the second handle within the second circular opening;

a first weight bar and a second weight bar configured to couple to the frame and configured to receive weights; and a first port extending from the frame and a first connector extending from the first weight bar, the first connector configured to secure within the first port to secure the first weight bar to the frame, wherein the first connector has a hexagonal cross section;

wherein the first handle and the second handle are configured to manipulate the weights during use.

20. The barbell of claim 19, further comprising:

a first tubular guide extending from the first outer member and configured to slidingly engage with the first outer bar and a second tubular guide extending from the first outer member and configured to slidingly engage with the second outer bar, wherein the first tubular guide and the second tubular guide allow for the first handle assembly to slide within the opening; and a locking pin configured to extend through the first tubular guide and into the first outer bar to lock the first handle assembly in a position.

* * * * *